US010422148B2

(12) United States Patent
Kitagawa

(10) Patent No.: US 10,422,148 B2
(45) Date of Patent: Sep. 24, 2019

(54) SHELL ELEMENT, SHELL STRUCTURE AND STRUCTURE FORMING SET

(71) Applicant: Jinzaikaihatsu-sienkikou Co., Ltd., Nagoya (JP)

(72) Inventor: Keisuke Kitagawa, Nagoya (JP)

(73) Assignee: JINZAIKAIHATSU-SIENKIKOU CO., LTD., Nagoya (JP)

( * ) Notice: Subject to any disclaimer, the term of this patent is extended or adjusted under 35 U.S.C. 154(b) by 0 days.

(21) Appl. No.: 16/094,204

(22) PCT Filed: Mar. 22, 2018

(86) PCT No.: PCT/JP2018/011292

§ 371 (c)(1),
(2) Date: Oct. 16, 2018

(87) PCT Pub. No.: WO2018/180840

PCT Pub. Date: Oct. 4, 2018

(65) Prior Publication Data

US 2019/0093375 A1 Mar. 28, 2019

(30) Foreign Application Priority Data

Mar. 30, 2017 (JP) ..... 2017-067076

(51) Int. Cl.
*E04H 1/12* (2006.01)
*B05B 15/00* (2018.01)
(Continued)

(52) U.S. Cl.
CPC ..... *E04H 1/1205* (2013.01); *B05B 15/00* (2013.01); *E04B 1/3211* (2013.01); *E04H 1/02* (2013.01);
(Continued)

(58) Field of Classification Search
None
See application file for complete search history.

(56) References Cited

U.S. PATENT DOCUMENTS 4,016,702 A 4/1977 Nakada et al.
5,313,763 A 5/1994 Oram
5,860,251 A * 1/1999 Gleich ..... A62C 3/0257 52/2.18
2002/0100228 A1* 8/2002 Yoder ..... E04G 11/22 52/80.1

FOREIGN PATENT DOCUMENTS

JP 52-22318 2/1977
JP 02-190541 7/1990
(Continued)

OTHER PUBLICATIONS

International Search Report for corresponding International Application No. PCT/JP2018/011292, dated Jun. 5, 2018.
(Continued)

*Primary Examiner* — Chinessa T. Golden
(74) *Attorney, Agent, or Firm* — Mori & Ward, LLP

(57) ABSTRACT

[Summary]
A shell element that can be formed simply and in a short time, a shell structure using the shell element, and a structure forming set that can form the shell element simply and in a short time are provided.
Resin material is foamed on the inside of thin film, a foamed material portion with bubbles being mixed is in the state of being sandwiched by the thin film and a solid layer, and tensional stress is applied to the thin film and the solid layer and compressive stress is applied to the foamed material portion, thus the shell element is difficult to be cracked or split, and the shell structure is formed by the shell element. And, the shell structure forming set forms the shell structure easily.

17 Claims, 13 Drawing Sheets

(51) Int. Cl.

| | |
|---|---|
| ***E04H 15/20*** | (2006.01) |
| ***E04H 15/32*** | (2006.01) |
| ***E04H 15/18*** | (2006.01) |
| ***E04H 1/02*** | (2006.01) |
| ***E04H 15/22*** | (2006.01) |
| ***E04H 15/54*** | (2006.01) |
| ***E04B 1/32*** | (2006.01) |
| *E04B 7/10* | (2006.01) |
| *E04G 11/04* | (2006.01) |

(52) U.S. Cl.

CPC ..... *E04H 15/18* (2013.01); *E04H 15/20* (2013.01); *E04H 15/22* (2013.01); *E04H 15/32* (2013.01); *E04H 15/54* (2013.01); *E04B 7/102* (2013.01); *E04B 2001/3264* (2013.01); *E04G 11/045* (2013.01); *E04H 2015/207* (2013.01)

(56) References Cited

FOREIGN PATENT DOCUMENTS

| | | |
|---|---|---|
| JP | 3077843 U | 6/2001 |
| WO | WO 2001/044593 | 6/2001 |

OTHER PUBLICATIONS

Written Opinion for corresponding International Application No. PCT/JP2018/011292, dated Jun. 5, 2018.

International Preliminary Examination Report for corresponding International Application No. PCT/JP2018/011292, dated Jul. 31, 2018.

* cited by examiner

SHELL ELEMENT, SHELL STRUCTURE AND STRUCTURE FORMING SET

TECHNICAL FIELD

The present invention relates to a shell element that forms a structure enclosing space easily and in a short time, a shell structure enclosing space by the shell element, and a structure forming set. In detail, the invention relates to the shell element, the shell structure and the structure forming set, which can provide shell structures that form habitable space easily and in a short time without utilizing heavy and bulky construction elements and machinery.

BACKGROUND ART

When a disaster occurred damaging many houses, assembling construction elements that are prepared beforehand provides temporary houses. Until the construction elements for temporary houses can be prepared, people are forced inconvenient living in a small living space separated by simple partitions in the inside of a big space covered with a roof such as gymnasiums. Moreover, since many unrecyclable components are used in conventional temporary houses, there were problems that when the temporary houses were removed, massive waste material piled up.

In Patent Literature 1, a technology of structures safe to external force is disclosed, which lines up several blocks made of foamed resin and induces compressive initial stress among the lined-up blocks by tightening parts. It is said to be possible to construct structures with a big span without utilizing pre-stressed concrete plates by inducing compressive initial stress to lined-up blocks by the tightening parts.

However, according to the technology mentioned in the Patent Literature 1, constructing structures easily and in a short time could not be done, since transportation vehicles were necessary to transport blocks because of the bulky nature of blocks made of foamed resin and lining up the blocks also necessitated construction machinery and took time as well. Also, there was a problem that the work to induce compressive initial stress by the tightening parts on a construction site was difficult and time-consuming.

In Patent Literature 2, a technology of assembly-type domes is disclosed, which lines up a plurality of blocks made of a plurality of foamed resin similarly as in the Patent Literature 1. It is claimed to be able to form half-sphered living space inside by gathering a plurality of blocks that constitute the assembly-type dome.

According to the technology in the Patent Literature 2, configuring corrugations that engage each other in facing surfaces of neighboring blocks prevents intrusion of external water. Connecting with adhesive and screws and surrounding and compressing the blocks to the connecting direction by compressive band plates integrate neighboring blocks, and it is claimed to be able to provide the assembly-type structures in a short time and with cheap construction expense.

However, similarly as in the Patent Literature 1, transportation vehicles were necessary to transport blocks because of bulky nature of the blocks made of foamed resin, and work to connect blocks by applying adhesive after lining up a plurality of blocks and to compress the plurality of blocks to the connecting direction by the compressive band plates was time-consuming, thus constructing structures easily and in a short time was difficult.

In Patent Literature 3, a technology of dome-shaped structure utilized for housing, etc. is disclosed. According to the technology mentioned in the Patent Literature 3, two folds of glass-fiber-reinforced plastic material are used and configures partition walls to divide the inside and outside of living space. It is claimed that the partition walls are lightweight and can be constructed in a short time, also have a good exterior appearance, and have a good performance of heat and sound insulation because of the double-layer structure.

However, even according to the technology mentioned in the Patent Literature 3, transportation vehicles were necessary to transport the glass-fiber-reinforced plastic that constitutes partition walls. Moreover, it was also necessary to produce the glass-fiber-reinforced material in a factory beforehand. Furthermore, forming arc-shaped inside frames and outside frames on the foundation of structure in order to guide and fix the base portion of the glass-fiber-reinforced plastic material was necessary. The dome-shaped structure mentioned in the Patent Literature 3 had a problem that preparation before the assembly was time-consuming.

According to the technologies mentioned in the Patent Literature 1 to 3, it was feasible to construct houses more simply and easily than constructing wooden or concrete-made houses as in a conventional way. However, at the time such as disaster lacking construction machinery, providing temporary houses for the purpose to use for a short time of several years simply and quickly was not feasible.

CITATION LIST

Patent Literature

Patent Literature 1: Japanese Unexamined Patent Application No. 1990-190541

Patent Literature 2: PCT International Publication No. WO 2001-044593

Patent Literature 3: U.S. Pat. No. 5,313,763

DISCLOSURE OF INVENTION

Problem to be Solved by the Invention

The inventor of the present invention researched structures that can be constructed simply and in a short time even at the time of disaster lacking construction machinery and reached to this present invention. The problem to be solved by the present invention is to provide a shell element that can be formed simply and in a short time, a shell structure utilizing the shell element, and a structure forming set that can form the shell structure simply and in a short time.

Means for Solving Problem

The first invention according to the present invention is a shell element that constitutes a shell structure enclosing space, and the characteristics of the shell element are: the shell element is composed of thin film that constitutes one side of surfaces of the shell element and layered foamed material portion, and the layered foamed material portion and the thin film are adhered and integrated; the other surface of the foamed material portion not adhered to the thin film has a solid layer with low foamed density; the surface of the solid layer facing to the space is exposed to the space; and tensional force acts on both the thin film and the solid layer, and compressional force acts on the foamed material portion except for the solid layer.

A shell structure is called in other words a curved-plate structure, but the shell element is not limited to a curved shell element and can be a flat plate. The thin film can permeate water vapor, and is preferably moisture-permeable waterproof sheet without permeating water, but not restricted, and can be paper or natural rubber material. And, the foamed material portion is preferable to be a foamed resin that foams organic resin but can be natural-rubber based resin. The mixed condition of bubbles in the foamed material portion may be such that bubbles are mixed either in a state of closed cells or in a state of open cells. Moreover, the sizes of bubbles are surely not restricted.

The foamed material portion is formed so as to make layers, and the number of layers is not restricted and may be determined depending on the size of shell structures or the locations to form the foamed material portion. For example, forming single layer is enough at the upper portion where the small external force acts, and it is better to form thick with a plurality of layers at the base portion where the large external force acts. Surely, the same number of layers may be formed from the base portion to the upper portion.

Moreover, the thickness of the layers made by the foamed material portion also can be not constant but can be made thick at the base and thin at the upper portion. The thin film with the foamed material portion being adhered is applied tensional force by expansion effect induced in the foaming process of the material constituting the foamed material portion. On the other hand, on the surface of foamed material portion of the side exposed to air, air of bubbles escapes from the sprayed surface, and volume of the solid layer portion contracts, thus the solid layer, on which tensional force is applied, with low bubble density in other words with high material density is formed. In the case that number of layers of the foamed material portion is made plural, solid layers with low bubble density are formed similarly on the surface of each layer of the foamed material portion of the side exposed to air.

In the shell element, tensional force develops in the thin film and the solid layer, and in the foamed material part sandwiched by those surfaces, i.e. in the foamed material portion except for the solid layer, compressional force induced by expansion associated with foaming remains without being weakened by the tensional force acting on the both surfaces. That is, tensional force is applied to both the thin film and the solid layer, and compressional force is being applied to the foamed material portion.

The solid layer with high material density has allowable tensile stress equivalent to the resin material itself. On the other hand, the foamed material portion, in other words, the portion with high bubble density, has small allowable tensile stress and tends to be broken. However, compressional force applied to the foamed material part remains until either the thin film or the solid layer breaks, thus tensional force hardly acts on the foamed material portion, then the foamed material portion does not break.

The thin film may be provided either on the internal side or external side of the shell element enclosing space. In the case that the shell element is made for a structure that people dwell, since the size of space is large, the foamed resin can be sprayed on the inner surface of the thin film from inside of the space without influence from the external environment. On the other hand, in the case that the size of space is small and work cannot be done inside, for example in the case of a small floating advertisement, the foamed resin can be sprayed on the external surface of the thin film from outside of the space.

According to the first invention of the present invention, since the shell element is lightweight, the favorable effect not previously achieved is realized that structures with high heat-insulation performance can be provided simply and in a short time without necessitating large-scale construction machinery. Moreover, since compressional force is applied to the foamed material portion sandwiched by the thin film and the solid layer with tensional force being applied, the favorable effect is realized that the foamed material part does not break by tensile force until the thin film or the solid layer are broken by the tensional force, even if bending stress is given to the shell element.

The second invention according to the present invention is characterized that the shell element of the first invention is curved convexly toward the outside of the space, and the foamed material portion adheres at least on the internal surface of the thin film. Configuring the thin film to form a closed space, the thin film can be easily curved convexly toward the outside by pressurizing the inside of the closed space with air. Since the shell element is curved convexly toward outside, the favorable effect is realized that the shell element of good quality with foamed resin being sprayed is made, which is not influenced by external wind, temperature, or humidity, and also the shell element can hardly be cracked or split by force acting from the outside.

The third invention according to the present invention is characterized that the shell element is curved convexly toward the outside of the space, and the foamed material portion adheres on the external surface of the thin film. Since the shell element is curved convexly toward outside, the favorable effect is realized that even small shell structures can be provided by spraying foamed resin from outside of the thin film, and also the shell element can hardly be cracked or split by force acting from the outside.

The fourth invention according to the present invention is the shell element of the first or the second invention and characterized that the thin film has a property of optical transparency. Since the foamed material portion includes bubbles, as far as the material itself is not colored deeply, optical-transparency performance according to the thickness of the foamed material portion appears.

According to the fourth invention, since the thin film has optical transparency, if the thickness of the foamed material portion is made thin, optical-transparency performance to transmit light can be given to the shell element. With this, even at the emergency lacking for electrical apparatus, a shell structure composed of the shell element can be a temporary house that utilizes light from the outside. Moreover, the favorable effect is realized that a structure composed of the shell element can be an advertising medium transmitting a message from the inside.

The fifth invention according to the present invention is the shell element of the first, the second or the fourth invention, and characterized that a flame-resisting layer is applied along the shape of the thin film at least either on the surface of the external side of the thin film or on the surface of the space side of the solid layer. Here, the flame-resisting layer can be a paint-coating layer or a foamed layer made of flame-resisting resin.

By applying the flame-resisting layer on the surface of the external side of the thin film, fire from the outside becomes difficult to spread. On the other hand, by applying the flame-resisting layer on the surface of the space side of the solid layer, fire can be used inside of the space. According to the fifth invention, the favorable effect is realized that the flame-resisting shell structures can be provided, in addition to being lightweight and high heat insulation.

The sixth invention according to the present invention is the shell element of the first, the second, the fourth or the fifth invention, and characterized that the layered foamed material portion is made of foamed material either of polyurethane resin or polyisocyanurate modified resin, and expansion ratio of the foamed material portion except for the solid layer is more than 20 times and less than 100 times.

According to the sixth invention, since the layered foamed material portion is foamed material either of polyurethane resin or polyisocyanurate modified resin, work for foaming and spraying is easy. Furthermore, since expansion ratio is more than 20 times and less than 100 times, strength and rigidity necessary for the shell element can be gained in addition to easy spraying work. With this, shell structures possessing necessary strength and rigidity can be easily provided.

The seventh invention according to the present invention is a shell structure enclosing space and characterized that the shell structure enclosing space includes the shell element of the first, the second, or from the fourth to the sixth invention. According to the seventh invention, it is easy to enclose space by the shell element that is lightweight and easily formed, and it is possible to provide the shell structure simply and in a short time without utilizing large-scale construction machinery. Moreover, there is an effect that the foamed material portion constituting the shell structures can be recycled.

The eighth invention according to the present invention is a structure forming set composed of single-layered thin film, a holding means of the thin film, a spraying means of foamed material, and resin material, and characterized as follows: the thin film is integrated to form a shape enclosing space, and has an opening portion to enable to open the outside and inside of the space; the holding means of thin film closes the space by holding the peripheral edge of the thin film, and enables the thin film to curve convexly toward outside; and the spraying means of foamed material can spray the resin material mixed with bubbles on the inner surface of the thin film that is curved convexly toward outside, and constructs a structure, in which a foamed material portion with an exposed solid layer of low bubble density adheres only to the inner surface of the thin film.

As for the structure forming set, thin film, a holding means of the thin film, a spraying means of foamed material, and resin material constitute one set of the structure forming set, but it is more preferable if an air-pressurizing means is added. In the holding means of the thin film, other than base structural parts, for example a foundation that adheres lower openings so that the lower openings of the structure can be closed, there shall be means such as touch fasteners, zip fasteners, adhesion means, or fitting means to close a doorway that allows entrance and exit of workers and so on, but not restricted.

If the inside of the thin film is pressurized by air, curving convexly toward the outside is easy and favorable, but in the case that an air-pressurizing means is not available, the thin film can be curved convexly toward the outside by applying tensional force from the outside. According to the structure forming set of the eighth invention, the favorable effect is realized that temporary structures can be provided in a short time without necessitating construction machinery at the time of disaster, etc.

Effect of the Invention

According to the first invention of the present invention, since the shell element is lightweight, the favorable effect not previously achieved is realized that structures with high heat-insulation performance can be provided simply and in a short time without necessitating large-scale construction machinery. Moreover, the favorable effect is realized that the foamed material part does not break by tensile force until the thin film or the solid layer are broken by the tensional force, even if bending stress is given to the shell element.

According to the second invention of the present invention, the favorable effect is realized that the shell element of good quality with foamed resin being sprayed is made, which is not influenced by external wind, temperature, or humidity, and also the shell element can hardly be cracked or split by force acting from the outside.

According to the third invention of the present invention, the favorable effect is realized that even a small shell structure can be provided, and also the shell element can hardly be cracked or split by force acting from the outside.

According to the fourth invention of the present invention, even at the emergency lacking for electrical apparatus, a shell structure composed of the shell element can be a temporary house that can utilize light from the outside. Moreover, the favorable effect is realized that a structure composed of the shell element can be an advertising medium transmitting messages from the inside.

According to the fifth invention of the present invention, the favorable effect is realized that a flame-resisting shell structure can be provided, in addition to being lightweight and high heat insulation.

According to the sixth invention of the present invention, a shell structure possessing necessary strength and rigidity can be easily provided.

According to the shell structure of the seventh invention of the present invention, it is possible to provide a shell structure simply and in a short time without utilizing large-scale construction machinery, and also there is an effect that a foamed material portion constituting the shell structure can be recycled.

According to the structure forming set of the eighth invention of the present invention, the favorable effect is realized that a temporary structure can be provided in a short time without necessitating construction machinery at the time of disaster, etc.

BEST MODE(S) FOR CARRYING OUT THE INVENTION

In order to provide simply and in a short time a shell element constituting a structure that is lightweight and hardly cracked or split, a resin material is foamed and sprayed on an internal side of a thin film to make a foamed material portion. A foamed material part is sandwiched by the thin film and a solid layer with low bubble density and constitutes a unified shell element.

Example 1

Figure 1:
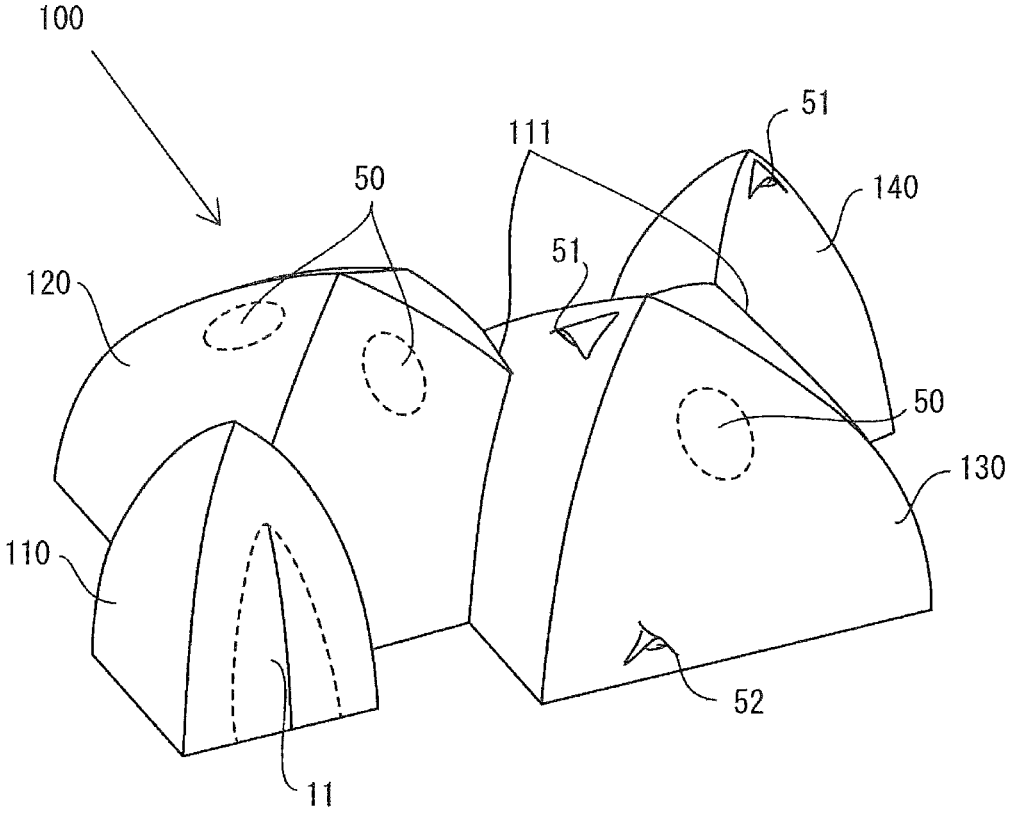
FIG. 1 is a perspective view of the shell structure (Example 1).
Figure 2:
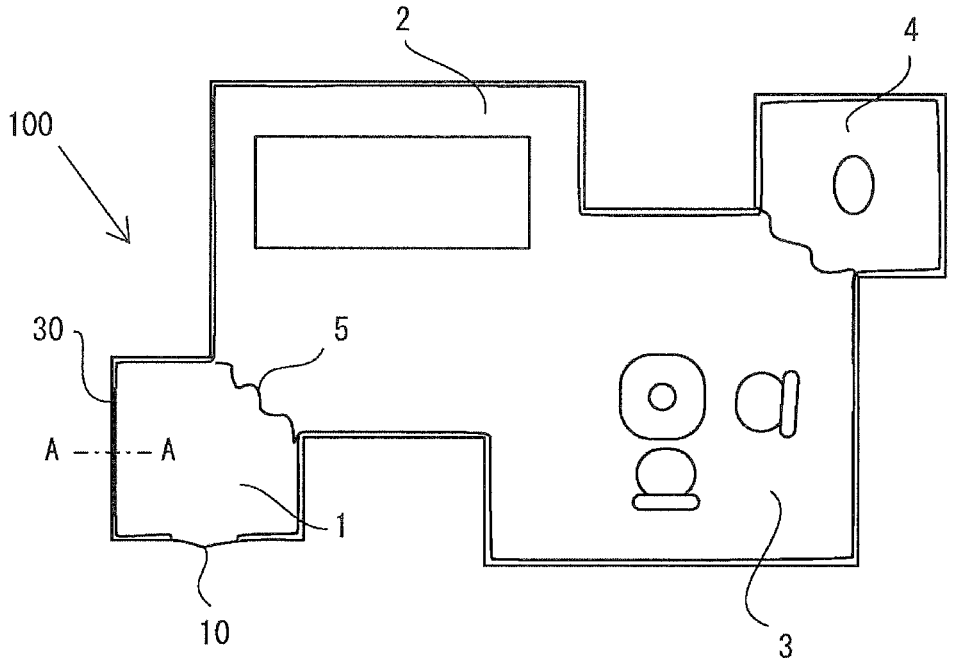
FIG. 2 is a plan view of the shell structure (Example 1).
Figure 3:
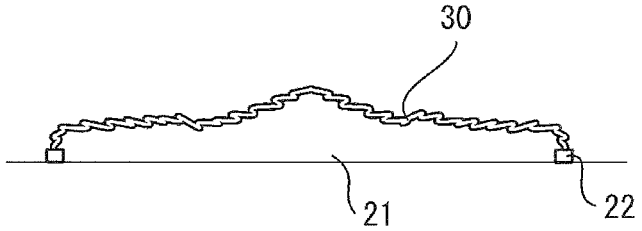
FIG. 3 is the first process in a forming method of the shell structure (Example 1).
Figure 4:
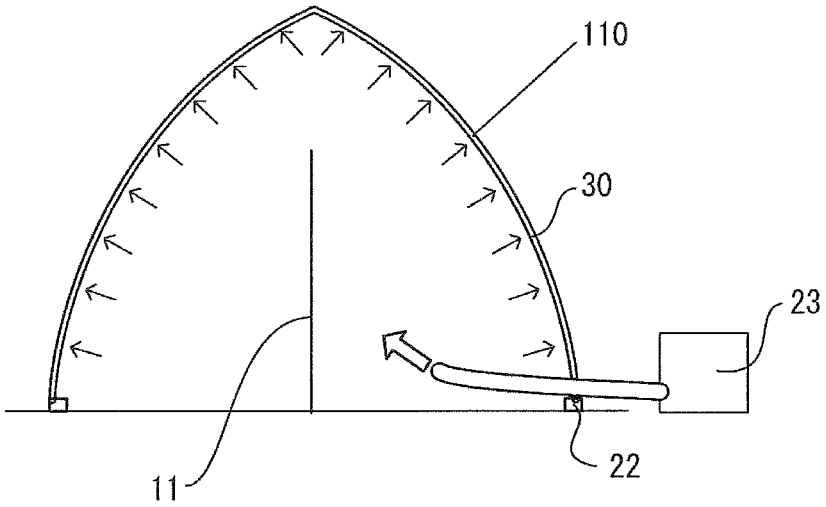
FIG. 4 is the second process in a forming method of the shell structure (Example 1).
Figure 5:
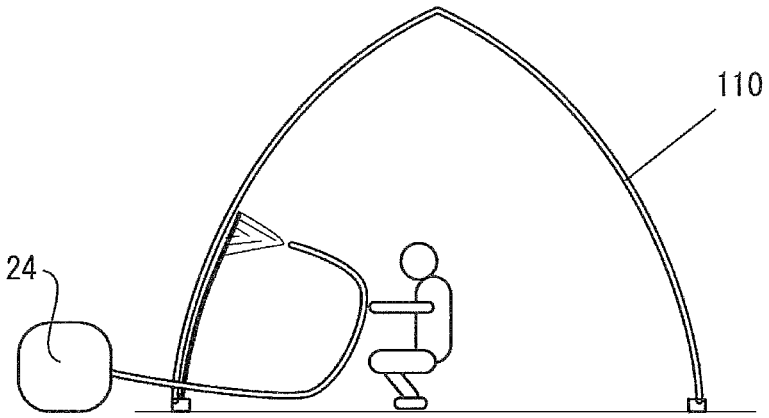
FIG. 5 is the third process in a forming method of the shell structure (Example 1).
Figure 6:
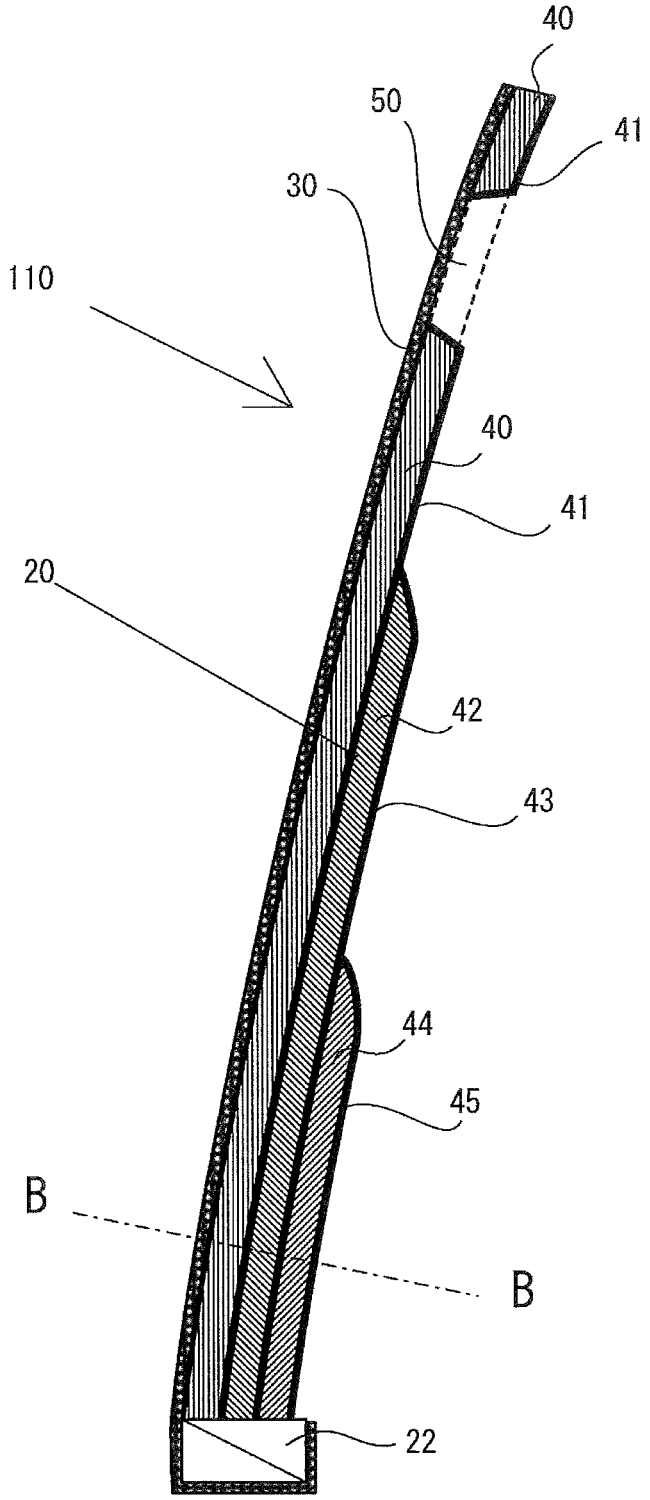
FIG. 6 is a sectional drawing of the shell element (Example 1).
Figure 7:
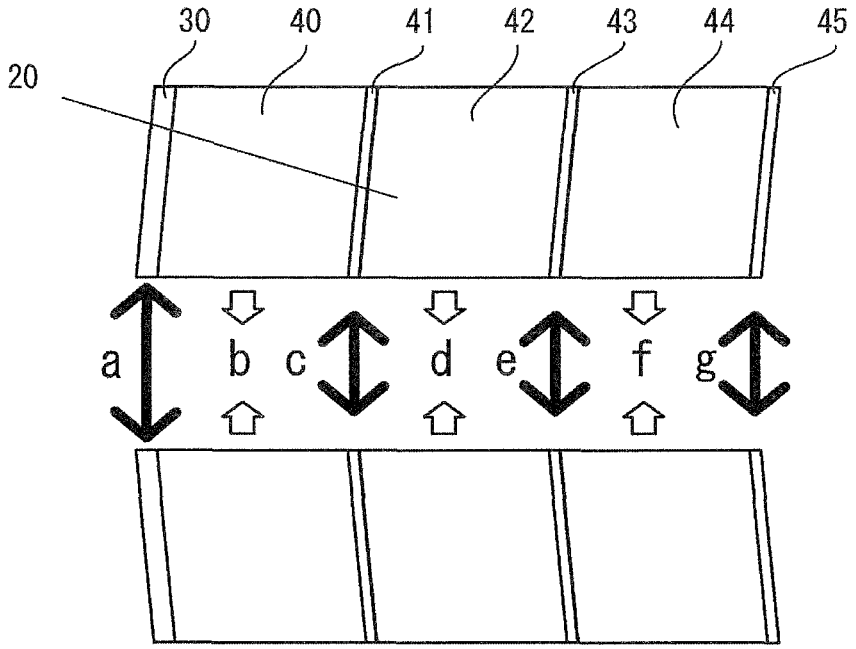
FIG. 7 is an explanatory drawing of the stress distribution (Example 1).
Figure 8:
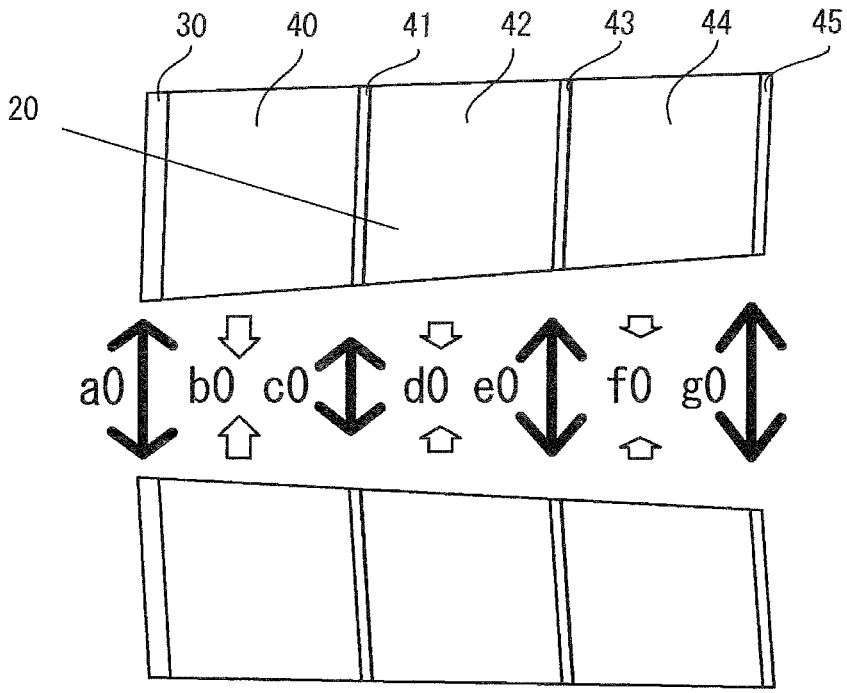
FIG. 8 is an explanatory drawing of the stress distribution (Example 1).

In example 1, a shell structure 100 is explained referring to from FIG. 1 to FIG. 6, which is one of temporary housing that integrates shell structures of approximately quadrangular pyramid 110, 120, 130, 140 composed of four shell elements with each surface being an approximately triangular shape. FIG. 1 shows a perspective view of the temporary housing, and FIG. 2 shows a plan view of the temporary housing. FIG. 3 shows explanatory drawings of a forming method of the shell elements. FIG. 6 shows a sectional drawing of location A-A in FIG. 2. FIG. 7 and FIG. 8 show the stress distribution of location B-B in FIG. 6, FIG. 7 shows stress distribution of the state without external force being applied and FIG. 8 shows stress distribution of the state, in which bending moment is occurring caused by pressing force of wind and so on.

The shell structure 100 is composed of an entry space into a living space, the living space integrating a sleeping space 2 and a dining space 3, and a hygienic space 4 that use water for a toilet and so on. The entry space 1 has a doorway 11 which enables entry from the outside and can be opened and closed by the engagement of touch fasteners 10 that prevent intrusion of rain or wind from the outside. The doorway 11 is composed of only the thin film without foamed material portion being adhered.

The thin film (refer to FIG. 6) uses a non-woven sheet having waterproofing moisture-permeable property, on which polyethylene superfine filaments of 4 μm average diameter are laminated and bound by only heat and pressure, and intends to prevent internal dew condensation of the foamed material portion. Seaming together the ridgelines of the thin film made of approximately triangular non-woven sheet makes four shell structures forming approximately triangular shapes with a different inclination of the ridgeline.

Furthermore, joining portions 111 integrating four shell structures 110, 120, 130, 140 are cut off beforehand, and seaming together the joining portions 111 unifies the inside of four shell structures. Seaming of the joining portions can be done by chemical fiber threads or fasteners. The thickness of thin film shall be from 0.3 mm to 1.0 mm, and optical-transparent performance is given to the thin film depending on the thickness.

Inside of the thin film 30, rigid polyurethane foamed resin is sprayed by spray nozzles and forms a foamed material portion 40. The expansion ratio shall be from 20 times to 100 times, but the ratio of from 30 times to 50 times is preferable from the viewpoint of ease of spraying work and strength and rigidity of the foamed material portion. Although rigid polyurethane foam is used due to ease of on-site operation, depending on the working environment of spraying, for example in the case of producing shell elements beforehand in a factory, polystyrene resin or polyolefin resin can be used.

Foamlite (registered trademark) manufactured by BASF INOAC Polyurethanes Ltd. is used for the rigid polyurethane foam resin. Foamlite is composed of two liquid ingredients, polyol ingredients including a polyol and other additives, and polyisocyanate ingredients. When polyurethane foam resin is sprayed, the foamed resin solidifies in several tens of seconds and becomes the state that air escaped from bubbles on the sprayed inner surface side, thus forms a solid layer (refer to FIG. 6) with low bubble density on the sprayed inner surface side.

Although the thickness of solid layer 41 differs depending on the sprayed thickness in one time of rigid polyurethane foam resin, in the case that the foamed material portion of rigid polyurethane foam resin with the thickness of 15 mm to 20 mm is sprayed, the solid layer of 0.5 mm thickness is formed on the surface of the foamed material portion. The solid layer 41 is a layer of high material density with air escaping from bubbles, has allowable tensile stress equivalent to the resin material, and is hardly broken.

In the upper portion of the thin film 30, an optically transparent portion 50 without the foamed material being sprayed is configured. Since the optically transparent portion 50 is only made of thin film having optical transparency, in the case that the external space is lighter than the internal space of the shell structure 100, the light transmits from the outside to the inside, and in the case that the external space is darker than the internal space of the shell structure 100, the light used in the internal space transmit outside. In the case of the shell structure being used as a temporary structure, the internal usage condition appears outside.

Also, in the living space 2, 3 inside of the shell structure 100, foods can be heated up by using simple warming equipment, such as a burner, an electric cooking device and so on, and a heat insulating mat is used as bedding, thus a minimum level of living is made possible. A nonflammable coating material is painted inside the shell element 20, thus the shell element becomes hardly flammable. Ventilation associated with the living of people is done through a ventilating part 51 in the upper portion and a ventilating part 52 in the lower portion. Also, the ventilating part 51 for exhausting air is installed in the hygienic space too. A partition film 5 is installed between the entry space 1 and the living space 2, 3, thus living is possible even leaving the doorway 11 open depending on the season.

Here, referring to from FIG. 3 to FIG. 5, the constructing method of the shell structure 100 is briefly explained. The thin film 30 constituting the shell structure is integrated by seaming together beforehand. For the first process, the lower opening part 21 of the seamed thin film is fixed by nails or an adhesive agent to a wooden foundation 22 forming the periphery so that the opening is closed. In the state of the lower opening part 21 being fixed to the wooden foundation 22, the doorway 11 is also closed by touch fasteners, etc., then the thin film 30 covers over the wooden foundation 22 in a slackened condition (refer to FIG. 3).

For the second process, air is pressurized and poured into the inside of the space enclosed by the closed thin film by an air-pressurizing means 23 (refer to the outlined arrow in FIG. 4). By the inside of the space being pressurized by poured air (refer to the fine-lined arrows in FIG. 4), each surface constituting the shell element 30 becomes the expanding state convexly outside (refer to FIG. 4).

In this state, while pouring air into the inside of the space, workers enter the space by opening the doorway 11, and the expanding state of the shell element 30 convexly outside is maintained even after closing the doorway 11. Then, for the third process, the workers spray foamed resin by a spraying means of foamed material 24 on the internal surface of the thin film 30 from lower portion successively upward (refer to FIG. 5).

The sprayed foamed resin becomes the state that the solid layer 41 (refer to FIG. 6) is formed on the surface in several tens of seconds, thus the rigidity is secured. The lower portion of the thin film 30 with the foamed resin being sprayed on the surface stabilizes the shape in a short time and becomes a self-standing state, thus spraying upward becomes easy. For the optically transparent portion 50, a frame is attached so that foamed resin is not sprayed. In the state that the first layer of the foamed material portion is formed by spraying the first layer of foamed material, the solid layer 41 with low bubble density is formed on the internal surface of the foamed material part 40 of the first layer of the foamed material portion.

Furthermore, the second layer of foamed resin is sprayed up to the middle height of the space enclosed by the thin film. After the solid layer 43 of the second layer is formed, again, the third layer of foamed resin is sprayed until the lower height (refer to FIG. 6). Up to the lower height, the internal surface of the thin film 30 becomes the state that three layers of foamed material portions where the foamed material part 40, 42, 44 are overlapped with the solid layers 41, 43, 45 are formed.

Here, with reference to FIG. 7 and FIG. 8, internal stress acting on the virtual cutting section of location B-B in FIG. 6 of the portion that the three layers of foamed material portions are formed is explained. FIG. 7 shows internal stress in the state in which no external force of the wind, etc. acts on the shell element 20. Since the thin film 30 is in the expanded state convexly outside, tensile stress (refer to a bold-lined arrow (a)) remains. Inside the foamed material part 40 of the first layer, since solidification occurs while expanding due to foaming, compressive stress (refer to an outlined arrow (b)) remains. On the solid layer 41, tensile stress (refer to a bold-lined arrow (c)) remains, since air is released from bubbles and contraction occurs before solidification.

Spraying work of foamed resin for the second layer is carried out after solidification of the first layer is stabilized. As similarly as the first layer, since the foamed material part 42 also solidifies while expanding, compressive stress (refer to a bold-lined arrow (d)) remains, tensile stress remains on the solid layer 41 of the first layer, and tensile stress (refer to a bold-lined arrow (e)) remains on the solid layer 43 too. Similarly in the third layer too, compressive stress (refer to a bold-lined arrow (f)) remains in the foamed material part 44, and tensile stress (refer to a bold-lined arrow (g)) remains on the solid layer 45.

Next, the state in which pressing force caused by external force of wind and so on acts on the shell element 20 is explained referring to FIG. 8. Bending moment develops at the location B-B in FIG. 6, tensional force acts at the third layer location on the inward side, and compressional force acts at the first layer location on the outward side. Then, tensile stress (refer to a bold-lined arrow (g0)) on the solid layer 45 of the third layer, since tensional force is added by the applied external force, becomes larger than the tensile stress (refer to a bold-lined arrow (g)) in the case with no external force being applied, and compressive stress (refer to an outlined arrow (f0)) in the foamed material part 44 of the third layer becomes smaller than the compressive stress (refer to an outlined arrow (f)) in the case with no external force being applied.

However, the solid layer 45 of the third layer does not break until tensile stress reaches the allowable tensile stress equivalent to the resin material constituting the foamed material portion. Then, until the solid layer 45 of the third layer breaks, tensional force does not act on the foamed material part 44 of the third layer, thus the effect that even the portion with high bubble density that is easy to be cracked or split by tensional force does not crack or split is realized.

Additionally, when external force of wind and so on becomes larger and the solid layer 45 of the third layer breaks due to the increased bending moment, cracks develop on the internal space side and breakage occurs inside the foamed material part 44 with small allowable tensile stress. And, the tensile stress (refer to a bold-lined arrow (e0)) acting on the solid layer 43 of the second layer increases more than the tensile stress (refer to a bold-lined arrow (e)) in the case with no external force being applied, and compressive stress (refer to an outlined arrow (d0)) in the foamed material part 42 of the second layer becomes smaller than the compressive stress (refer to an outlined arrow (d)) in the case with no external force being applied.

However, since the shell element 20 is curved convexly toward outside, even if cracks occur on the foamed material part 44 and the solid layer 45 of the third layer, the shell element 20 hardly protrudes convexly toward the inside, also cracked portion of the third layer is difficult to spread to the collapse of the whole shell structure 110 at once, and since layers are overlapped, the shell structure 110 (refer to FIG. 1 and FIG. 6) is difficult to collapse and maintains stable condition. Furthermore, in the case that external force to pull the shell element 20 outside occurs, tensile force acts on the outside layer and compressional force acts on the inside layer. However, similarly as in the case that pressing force is applied by wind and so on, the shell structure is difficult to collapse and maintains a stable condition.

Example 2

Figure 9:
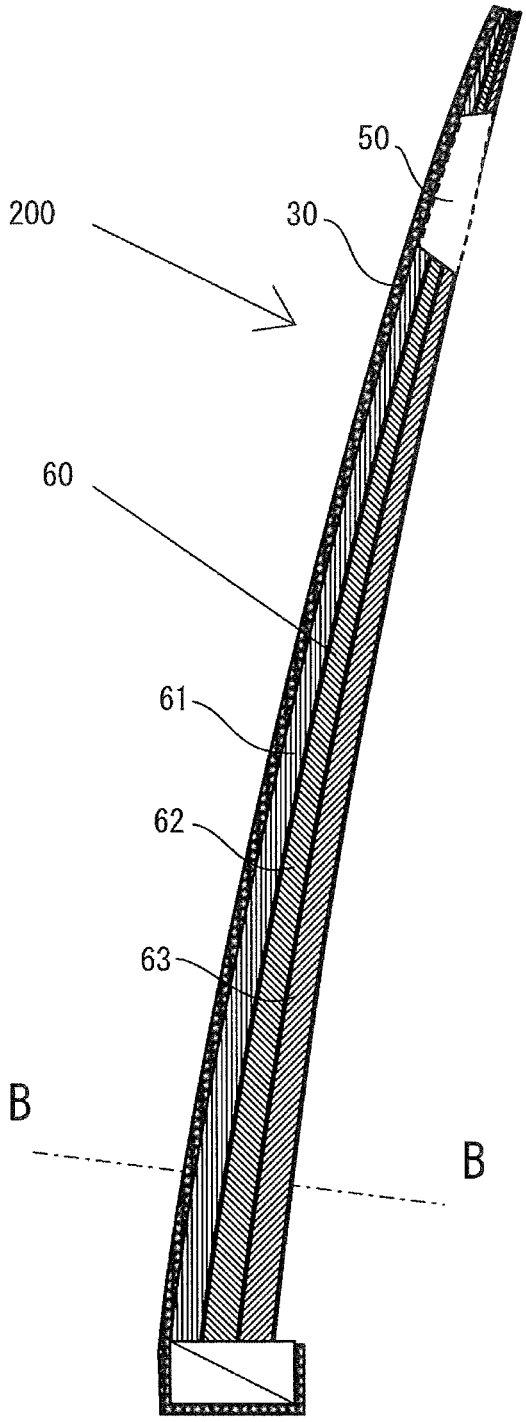
FIG. 9 is a sectional drawing of the shell element (Example 2).

In example 2, with reference to FIG. 9, a shell structure 200 composed of a shell element 60 of the same sprayed layers from the lower portion to the upper portion and with the sprayed thickness that is made thick in the lower portion and thin in the upper portion is explained.

For the shell element in example 2, three layers of foamed material portion 61, 62, 63 are sprayed from the lower portion to the upper portion on the inner side of the thin film. Each layer of the foamed material portion is sprayed thick in the lower portion and thin in the upper portion respectively. Specifically, each layer is sprayed 20 mm to 30 mm thick in the lower portion, each layer is sprayed so that the upper portion becomes thinner, and 8 mm to 10 mm thickness is sprayed in the upper portion.

In the shell element 60 constituting the shell structure 200, stress relation similar to the internal stress of the shell element 20 in example 1 that was explained at the location B-B in FIG. 6 appears at each portion from the lower portion to the upper portion. In the case that force of wind and so on from the outside is applied to the shell structure 200, since large stress develops in the lower portion of the shell structure 200, the thickness of the lower portion of the shell element 60 is made thick. The used quantity of resin material is saved by varying thickness of each portion of the shell element according to the magnitude of internal stress developed by external force. Furthermore, since the thickness of each portion of the shell element varies gradually from the lower portion to the upper portion, there is no portion where internal stress discontinuously changes, and occurrence of crack or split against external force from the outside is more difficult.

Example 3

Figure 10:
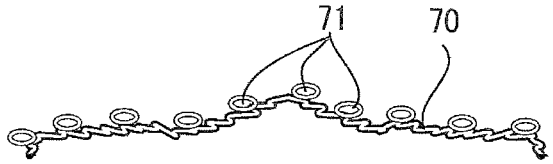
FIG. 10 is the first process in a forming method of the shell structure (Example 3).
Figure 11:
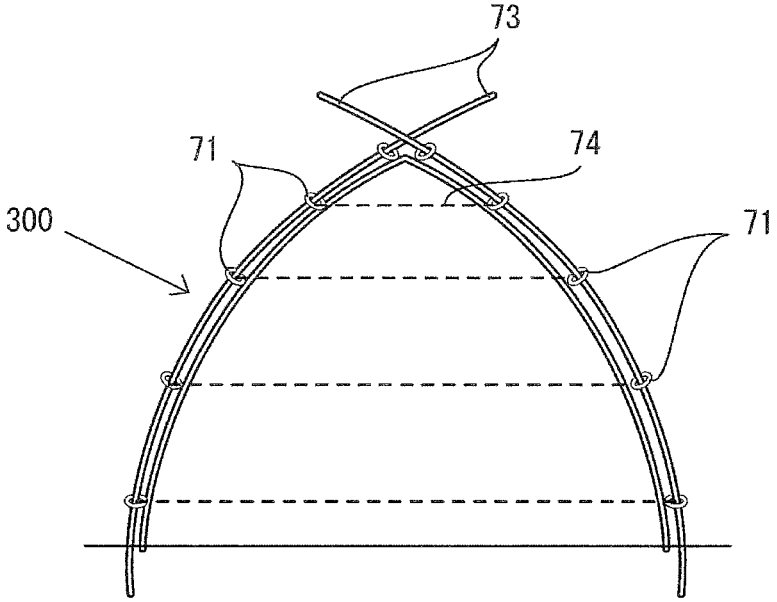
FIG. 11 is the second process in a forming method of the shell structure (Example 3).
Figure 12:
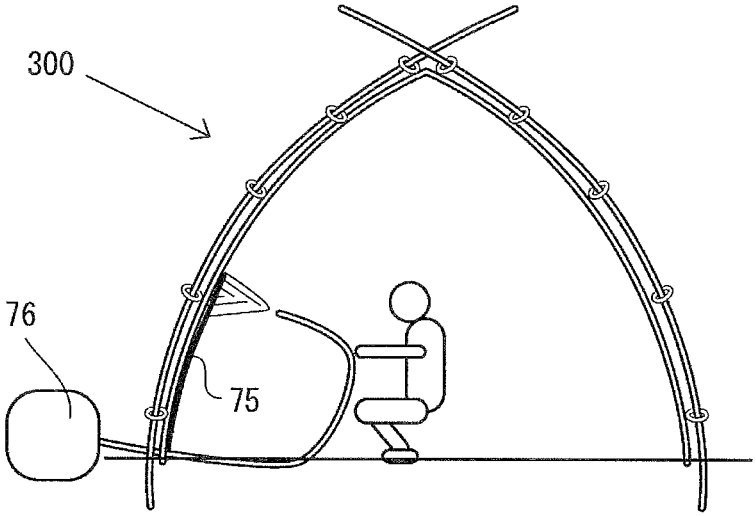
FIG. 12 is the third process in a forming method of the shell structure (Example 3).

In example 3, with reference to from FIG. 10 to FIG. 12, an explanation is made about a shell structure 300 that can respond even to the case where the air-pressurizing means (refer to FIG. 4) cannot be run due to no available electric power. For the first process, the thin film is to be prepared, in which rings 71, 71, . . . are sewn on each ridge of the thin film 70 constituting the shell structure 300 (refer to FIG. 10). Moreover, rings are also sewn on the external surface of the thin film 70 between rings 71 and 71 lined up horizontally (a drawing is omitted).

For the shell structure 300 in example 3, the lower opening of the thin film 70 may not be fixed on the wooden foundation 22 (refer to FIG. 4) and may be buried in the soil or left open. For the second process, in order to make the thin film 70 in the state of being expanded convexly outside, rods 73 with superior restoration property such as carbon fiber or glass fiber shall be inserted through the rings 71, 71, . . . on the ridges in a manner of intercrossing horizontally and vertically, and the rods 73 shall be deformed so that the thin film becomes the state of being expanded convexly outside.

More specifically, after inserting the rods 73 through the rings 71 vertically, the rods 73 shall be curved by the way such as burying the lower portion of the rods 73 and binding the upper portion of the rods 73, thus the thin film 70 shall be made in the state of being expanded convexly outside (refer to FIG. 11). Furthermore, although shown in broken lines in FIG. 11, the rods 74 shall be inserted in a horizontal direction into the rings 71 lined up horizontally while curving the rods gently, then making the thin film 70 in the state of being expanded convexly outside with the rods of both vertical and horizontal directions is preferable.

And, similarly as in example 1 or example 2, it is the same to foam and spray resin material on the internal surface of the thin film 70 and adhere foamed material portion 75 (refer to FIG. 12) on the internal surface of the thin film 70 for the third process. With encapsulating resin material and liquid air into a storing box 76 beforehand, it is good to foam the resin material by ejected liquid air in the storing box 76.

Although drawings are omitted, if the structure forming set, which contains the rods as a thin film holding means and resin material encapsulated in the storing box and liquid air encapsulated inside of the storing box as a spraying means of foamed material, is always made available at evacuation places at the time of disaster, shell structures can be easily provided and preferable at emergency such as at the time of disaster. Furthermore, after forming shell structures, the rods are taken out from the rings 71 and can be reused to form other shell structures.

Example 4

Figure 13:
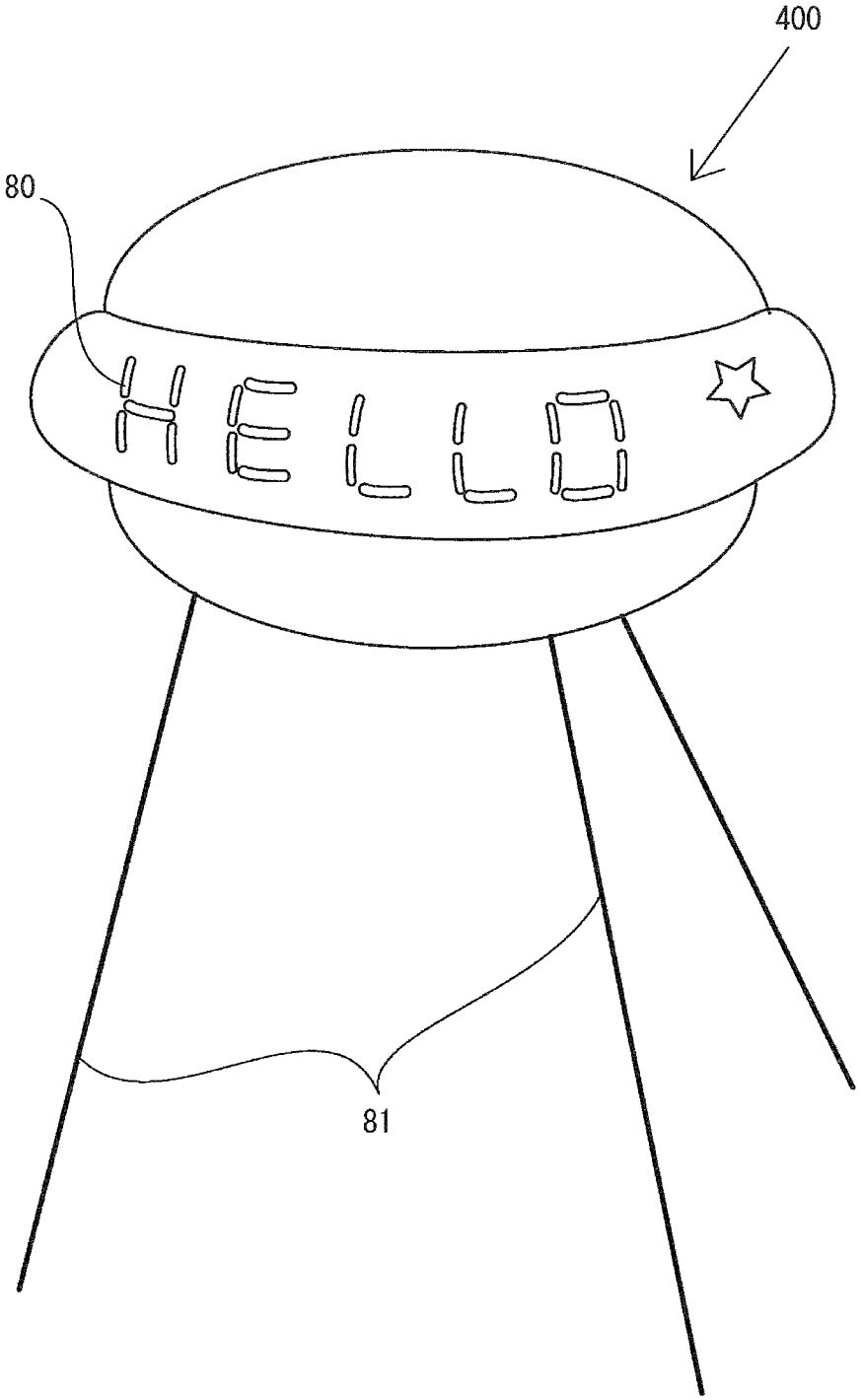
FIG. 13 is an explanatory drawing of the advertising medium (Example 4).

In example 4, with reference to FIG. 13, a floating advertisement 400 with optical-transparency performance is explained. For the floating advertisement 400 fixed by an anchor 81, a foamed resin is sprayed on the thin film except for a message-transmitting portion 80 toward outside. Moreover, inside the floating advertisement 400, an illumination means (drawings are omitted) composed of LED lights and an electric power source is installed.

Since the floating advertisement is the size that foamed resin cannot be sprayed from the inside of thin film and a foamed material portion cannot be formed inside of the thin film, a foamed resin is sprayed on the thin film from the outside while the thin film is expanded by blowing air into the thin film. Making the thickness of thin film thin, making the thickness of foamed material portion thin, and enclosing lighter gas than air into the internal space enable to use as a floating advertisement. Compared with a floating advertisement that encloses lighter gas than air into the inside of the thin film, the shell element is difficult to be damaged by birds, etc., thus has superior stability as an advertisement medium.

(Others)

Although an example in the case of constructing a shell structure on site is explained in each example, it is also a good idea to form shell elements beforehand in a factory and so on and joint them at the site.

Moreover, although examples of shell structures of three layers are shown, the number of layers is surely not restricted and can be one layer or more than four layers depending on the scale of shell structures.

Dimensions shown in the examples are merely examples and are certainly not restricted.

The intended use of temporary structures that the present invention applies is not restricted to structures aimed for housing, but may be structures aimed for food storage or a morgue.

The embodiments disclosed here are illustrative examples in all respects, and it should be considered that the embodiments are not restrictive. The technical scope of the present invention is shown by claims without being restricted to the above explanation, and all modifications are intended to be included in the same meaning and range as the claims.

REFERENCE SIGNS LIST

100, 110, 120, 130, 140, 200, 300 . . . shell structure,
111 . . . joining portion,
1 . . . entry space, 2 . . . sleeping space, 3 . . . dining space,
4 . . . hygienic space, 5 . . . partition film,
10 . . . touch fastener, 11 . . . doorway, 20 . . . shell element,
21 . . . opening part,
22 . . . wooden foundation, 23 . . . air-pressurizing means,
24 . . . spraying means of foamed material,
30 . . . thin film, 40, 42, 44 . . . foamed material part,
41, 43, 45 . . . solid layer,
50 . . . optically transparent portion,
51, 52 . . . ventilating part,
60 . . . shell element, 61, 62, 63 . . . foamed material portion,
70 . . . thin film, 71 . . . ring, 73, 74 . . . rod,
75 . . . foamed material portion,
76 . . . storage box,
400 . . . floating advertisement, 81 . . . anchor,
80 . . . message portion

The invention claimed is:

1. A shell element constituting a shell structure enclosing space, wherein:

the shell element is composed of thin film that constitutes one side of surfaces of the shell element and a layered foamed material portion;

one surface of the layered foamed material portion adheres to the thin film, thus the thin film and the layered foamed material portion are integrated;

another surface of the layered foamed material portion that does not adhere to the thin film forms a solid layer with low bubble density in which bubbles escaped from the another surface;

an entire surface of the solid layer facing toward the space is exposed to the space; and tensile force is applied to both of the thin film and the solid layer and compressional force is applied to the layered foamed material portion except for the solid layer.

2. The shell element according to claim 1, wherein:

the shell element is curved convexly toward an outside of the space; and the layered foamed material portion adheres at least to an inner surface of the thin film.

3. The shell element according to claim 2, wherein the thin film is optically transparent.

4. The shell element according to claim 2, wherein a flame-resisting layer is formed along a shape of the shell element at least on either an outer surface of the thin film or a space-side surface of the solid layer.

5. The shell element according to claim 2, wherein the layered foamed material portion is made of foamed material either of polyurethane resin or polyisocyanurate modified resin and an expansion ratio of the layered foamed material portion except for the solid layer is more than 20 times and less than 100 times.

6. Shell structures enclosing space comprising a shell structure including the shell element according to claim 2.

7. The shell element according to claim 1, wherein the thin film is optically transparent.

8. Shell structures enclosing space comprising a shell structure including the shell element according to claim 7.

9. The shell element according to claim 1, wherein a flame-resisting layer is formed along a shape of the shell element at least on either an outer surface of the thin film or a space-side surface of the solid layer.

10. Shell structures enclosing space comprising a shell structure including the shell element according to claim 9.

11. The shell element according to claim 1, wherein the layered foamed material portion is made of foamed material either of polyurethane resin or polyisocyanurate modified resin and an expansion ratio of the layered foamed material portion except for the solid layer is more than 20 times and less than 100 times.

12. Shell structures enclosing space comprising a shell structure including the shell element according to claim 11.

13. Shell structures enclosing space comprising a shell structure including the shell element according to claim 1.

14. The shell element according to claim 1, wherein the layered foamed material portion is provided so as to be thick in a lower portion and to be thin in an upper portion.

15. The shell element according to claim 1, wherein the shell element includes a plurality of the layered foamed material portions and each of the layered foamed material portions includes the solid layer.

16. The shell element according to claim 15, wherein each of the layered foamed material portions is provided so as to be thick in a lower portion and to be thin in an upper portion.

17. A structure forming set that is characterized as follows:

the structure forming set is composed of single-layered thin film, a holding means of the thin film, a spraying means of foamed material, and resin material;

the thin film is integrated to form a shape enclosing space and has an opening portion to enable to open an outside and an inside of the space;

the holding means of thin film closes the space by holding a peripheral edge of the thin film and enables the thin film to curve convexly toward the outside; and the spraying means of foamed material can spray the resin material mixed with bubbles on an inner surface of the thin film that is curved convexly toward the outside, and constructs structures, in which one surface of a foamed material portion adheres only to the inner surface of the thin film and another surface of the foamed material portion that does not adhere to the thin film forms a solid layer with low bubble density in which bubbles escaped from the another surface, an entire surface of the solid layer facing toward the space being exposed to the space.

* * * * *